United States Patent [19]

Shaw et al.

[11] 4,104,741

[45] Aug. 8, 1978

[54] NOVELTY HAT DEVICE

[76] Inventors: Lamont Shaw, 735 Cummins Hwy., Mattapan, Mass. 02126; Aaron O. Waire, 1066 Ellicott St., Buffalo, N.Y. 14209

[21] Appl. No.: 787,979

[22] Filed: Apr. 15, 1977

[51] Int. Cl.[2] ..... A42B 1/24

[52] U.S. Cl. ..... 2/185 R; 2/171.1; 46/9; 46/88; 272/8 F

[58] Field of Search ..... 46/9, 87, 88, 90, 196, 46/174, 176; 272/8 F, 8 R, 8 N; 2/185 R, 175, 195, 199, 171.1

[56] References Cited

U.S. PATENT DOCUMENTS

| | | | |
|---|---|---|---|
| 1,300,640 | 4/1919 | Pasternak | 46/87 |
| 2,593,188 | 4/1952 | Rikelman | 46/88 X |
| 2,665,676 | 1/1954 | Mobley, Jr. | 46/9 X |
| 2,856,732 | 10/1958 | Weismantel | 46/90 X |
| 3,750,192 | 8/1973 | Beresic | 2/185 R |

FOREIGN PATENT DOCUMENTS

| | | | |
|---|---|---|---|
| 25,850 of | 1897 | United Kingdom | 2/199 |

*Primary Examiner*—Peter Nerbun
*Attorney, Agent, or Firm*—William Nitkin

[57] ABSTRACT

An amusement device comprising a hat having a balloon compartment positioned at the top of the hat having defined therein a plurality of vent apertures and a tube receiving aperture; a tube having a first and second end, said second end passing through said tube receiving aperture; an air pump affixed to the first end of said tube; a balloon affixed to the second end of said tube; and a predetermined amount of powder-like substance located within said balloon compartment adapted to be blown out said compartment upon inflation and bursting of said balloon.

3 Claims, 3 Drawing Figures

FIG. 1
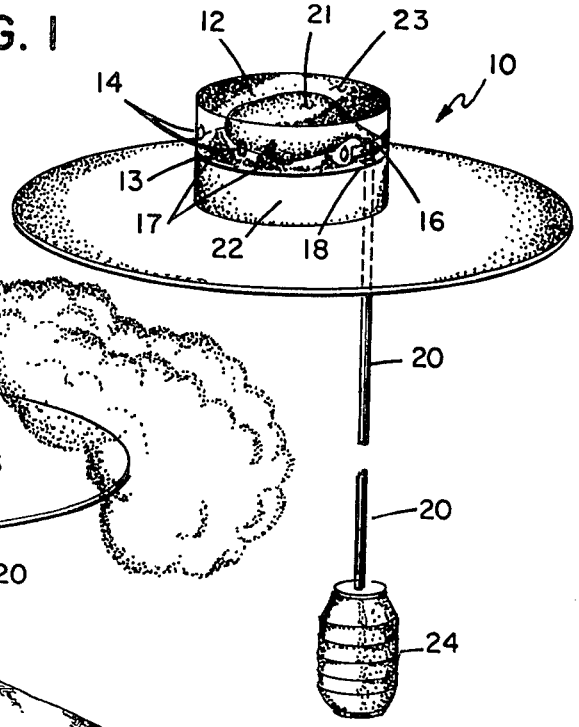
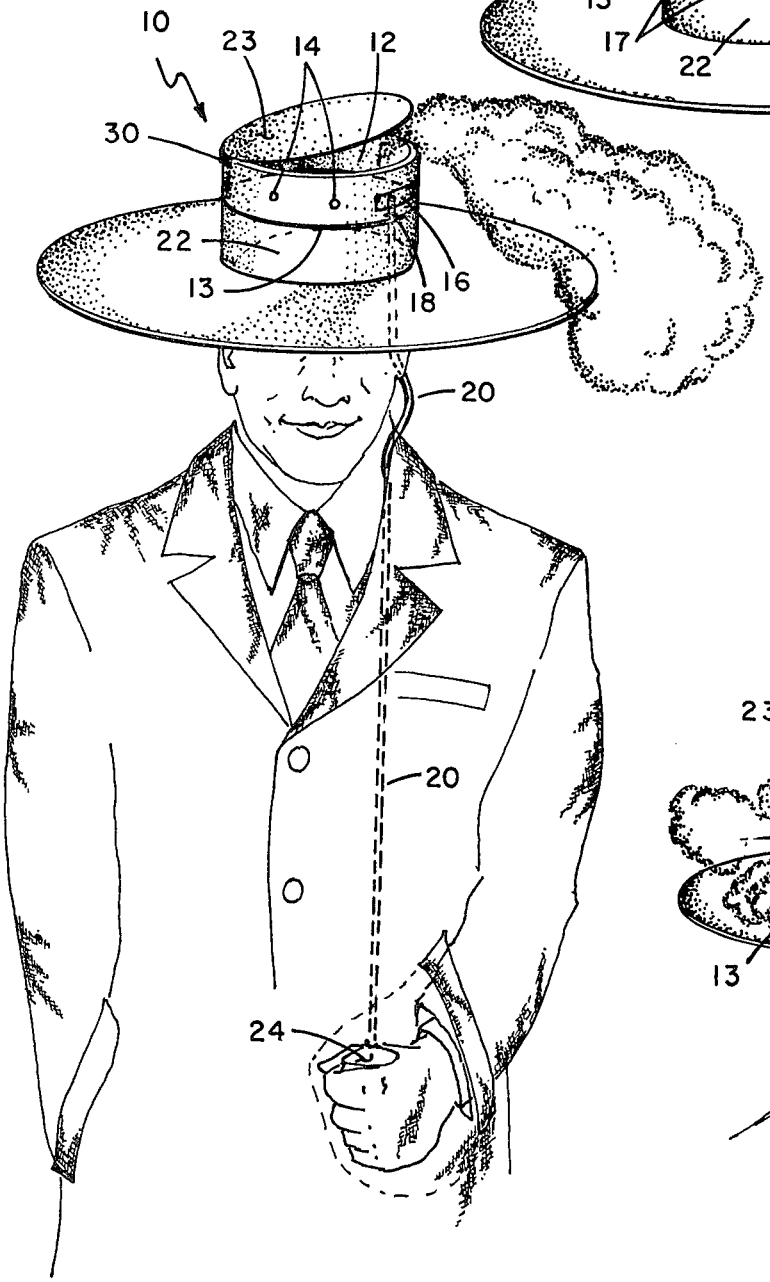
FIG. 2
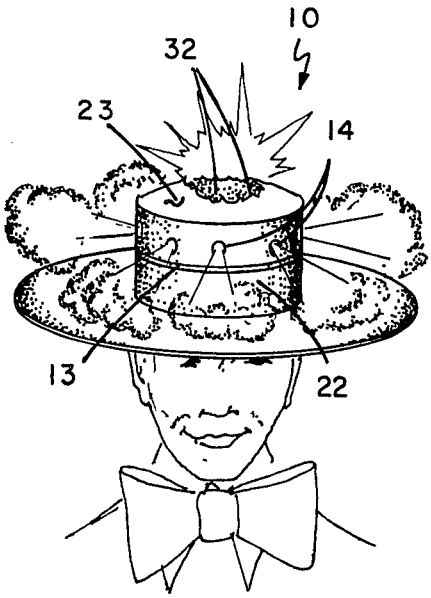
FIG. 3

NOVELTY HAT DEVICE

BACKGROUND OF THE INVENTION

The device of this invention resides in the area of novelty and entertainment devices and more particularly in the area of hats having amusement apparatuses contained therein.

In the prior art noted by applicants, balloons having the shape of hats have been utilized as disclosed in U.S. Pat. 1,554,052 to Slye. Further, as display items, balloons have been utilized, being in the shape of a head, for mounting hats thereon as disclosed in U.S. Pat. No. 1,436,330 to Weiner. Balloons have also been utilized in inflatable toys with a hat as part of the toy such as disclosed in U.S. Pat. No. 2,685,758 to Ochs. Balloons have been further utilized in aerial toys which may further show a face and hat elements such as seen in U.S. Pat. No. 1,858,460 to Ranseen. Balloons have also been utilized in the manufacture of caps for use as novelty items where the balloon is ornamentally decorated with a face thereon such as disclosed in U.S. Pat. No. 1,536,816 to Sale. Further, balloons have been utilized as wig supports when inflated as seen in U.S. Pat. No. 3,465,927 to Belokin. Another patented design for a balloon in the shape of a hat was issued to Dixcy, U.S. Pat. No. 21,874.

While the above prior art cited by the applicants discloses balloons used as heads or in configurations with hats, they do not disclose the device of this invention which utilizes the balloon as a mechanical element to cause the effect of a person wearing the hat to "blow his top."

SUMMARY

Therefore it is an object of this invention to disclose a hat which when desired by the wearer, can "blow its top" letting off "steam" in the form of powder. The device of this invention consists of a hat having a balloon compartment positioned at the top thereof having a plurality of vent apertures defined in the circumference of said balloon compartment, and a balloon located therein attached by a tube running from the hat to the wearer's hand wherein an air pump provides air to inflate the balloon within the hat. An optional amount of powder, such as talcum powder, is contained within the balloon compartment. The brim of the hat in a further embodiment can be affixed such that when the balloon inflates, a point is reached where the balloon causes the top of the hat to break off and upwards at which point the balloon also bursts causing an explosion of air and additionally causing the powder contained within the balloon compartment to spew out giving the effect of an individual "blowing his top."

BRIEF DESCRIPTION OF THE DRAWINGS

FIG. 1 illustrates a cutaway perspective view of the device of this invention.

FIG. 2 illustrates the device of this invention in position on an individual's head showing the embodiment wherein the lid of the hat is shown flipped open.

FIG. 3 illustrates the device of this invention having a paperlike top shown bursting open.

DESCRIPTION OF THE PREFERRED EMBODIMENT

FIG. 1 illustrates a cutaway perspective view of the device of this invention. Seen in this view is hat 10 which can be any style of hat with or without a brim. For purposes of illustration, a hat having a brim is utilized. The hat has at its top balloon compartment 12 and a plurality of vent apertures 14 defined within the balloon compartment for the release of powder 17, such as talcum powder, which is blown into the air through vent apertures 14 when balloon 21 bursts within balloon compartment 12. Balloon 21 is seen in a deflated position affixed at its open end to tube 20 which passes through aperture 18 in the base of baffle 13 of balloon compartment 12 and down the inside of the hat. Tube 20 should be of sufficient length to reach to the wearer's hand. At the first end of tube 20 is air pump 24 which can be a hand-operated one-way air pump in order to inflate the balloon within the balloon compartment. Seen further in FIG. 1 is balloon opening aperture which can consist of a slit or other type of opening which can have closing means so as not to be noticeable within the balloon compartment whereby one can gain access to the second end of tube 20 for removal of the burst balloon and for insertion thereon of a fresh balloon and for the placement of new powder within the balloon compartment at the top of the hat so that the hat can be reused. In this embodiment, when the hat is placed on the wearer's head which enters into the head receiving area 22, the individual squeezes air pump 24 until balloon 21 within hat 10 reaches its maximum inflation and bursts thereby causing powder 17 which can be talcum powder or equivalent within the balloon compartment to blow out through vent apertures 14, thereby giving the appearance of the wearer "blowing his top."

FIG. 2 illustrates an individual using the device of this invention with air pump 24 in his pocket and tube 20 seen in outline passing up through his clothing to balloon compartment 12 where the lid and top of the hat are illustrated at the point of bursting causing the powder to spew out the top of the hat. In this embodiment balloon 21 can be designed so that its bursting point is also the point at which lid 23 of the hat breaks off the top of the hat at premade weaker portions so that it flips on hinge element 30 thereby giving the effect of the wearer "flipping his lid." In this embodiment the hinge element can be constructed of cloth and the remaining attachments to the top of the hat of lid 23 can be constructed of paper. It should be noted that the balloon must be of particular dimensions and thickness so that it will burst at the desired point in its inflation. The lid of the hat, while it can be "flippable" as discussed above, can also be constructed of a paperlike material 33 which will burst when the balloon bursts within the balloon compartment expecially by the pressure of the expanding balloon against it as seen in FIG. 3.

Although the present invention has been described with reference to particular embodiments, it will be apparent to those skilled in the art that variations and modifications can be substitute therefor without departing from the principles and spirit of the invention.

We claim:

1. A novelty amusement device to be placed on the user's head comprising:

a hat having defined therein a head receiving area;

a balloon compartment positioned at the top of said hat above said head receiving area having defined therein a plurality of vent apertures around its outer circumference;

a baffle member forming the base of and separating said balloon compartment from said head receiving area and further having a tube receiving aperture defined therein;

a tube having a first and second end, said second end passing into said head receiving area and through said tube receiving aperture;

a manually operated air pump affixed to the first end of said tube;

a balloon removably affixed to the second end of said tube and positioned within said balloon compartment, said balloon being of a size to expand fully on inflation within the limits of the volume size of said balloon compartment and adapted to burst upon further inflation; and a powder-like substance located within said balloon compartment adapted to be blown out of said vent apertures upon the bursting of said balloon after its inflation by said manually operated air pump, said balloon compartment further having defined therein a balloon entry aperture through which burst balloons can be removed and new balloons and powder inserted.

2. A device as recited in claim 1 wherein said balloon compartment further includes a hingeably attached top lid member having additional releasable attachment means to the circumference of said balloon compartment adapted to separate from the circumference of said balloon compartment along said releasable attachment means upon receiving the force of the bursting balloon within said balloon compartment.

3. A device as recited in claim 1 wherein said balloon compartment further includes a top lid member of paper-like material adapted to burst outward upon the bursting of said balloon.

* * * * *